US005491939A

United States Patent [19]

Wang

[11] Patent Number: 5,491,939

[45] Date of Patent: Feb. 20, 1996

[54] PREFABRICATED STAIRCASE UNIT

[76] Inventor: Jyh L. Wang, No. 910, Jiann Gwo Road, Ba Der Hsiang, Taoyuan Hsien, Taiwan

[21] Appl. No.: 318,254

[22] Filed: Oct. 5, 1994

[51] Int. Cl.[6] ..... E04F 11/00

[52] U.S. Cl. ..... 52/185; 52/638

[58] Field of Search ..... 52/182, 185, 638, 52/184, 187; 182/132, 120, 117

[56] References Cited

U.S. PATENT DOCUMENTS

| | | | |
|---|---|---|---|
| 653,442 | 7/1900 | Dunk | 52/185 |
| 3,228,154 | 1/1966 | Mulitz | 52/185 |
| 3,670,848 | 6/1972 | Raiguel, Jr. | 52/185 X |
| 3,927,518 | 12/1975 | Simmons et al. | 52/185 X |
| 4,364,206 | 12/1982 | Wybauw | 52/185 X |
| 4,967,878 | 11/1990 | Adams | 52/638 X |

*Primary Examiner*—Carl D. Friedman
*Assistant Examiner*—W. Glenn Edwards
*Attorney, Agent, or Firm*—Bacon & Thomas

[57] ABSTRACT

A prefabricated staircase unit includes four steel columns, at least four steel cross bars and a staircase. The steel columns are disposed vertically to form a rectangular space. Each steel column has attaching devices at both ends for attaching a steel column of a second staircase unit. Each steel cross bar is disposed horizontally for connecting different steel columns. The staircase is disposed within the space defined by the four steel columns and the steel cross bars. Each staircase consists of a base landing, an intermediate landing and a series of steps.

1 Claim, 2 Drawing Sheets

PREFABRICATED STAIRCASE UNIT

BACKGROUND OF THE INVENTION

While constructing a building, a staircase must be provided between two consecutive floors for allowing people to walk from one floor to another. Conventional staircases may be constructed on-site through a reinforced concrete structure or a steel structure. The on-site reinforced concrete construction of the staircase includes the steps of: (1) drawing a sketch on the side wall, according to the design of the staircase to be constructed, after the columns, beams, floors and walls of the main structure are completed; (2) setting up a mold board and holding it in place by struts and braces; (3) arranging and wrapping reinforcement steel bars within the space defined by the mold board; (4) pouring concrete in the space formed by the mold board; (5) removing the mold board after setting of the concrete; (6) coating plaster on the surface of the steps formed; and (7) finishing the surface of the steps. This on-site reinforced concrete construction of a staircase is complicated and labor-intensive. Another drawback is that the schedule of the staircase construction is difficult to control. Furthermore, it is difficult to build the steps within a desired accuracy of dimension and therefore final finished work is commonly required.

The steel structure construction of the staircase includes the steps of: (1) making a framework elements from structural steel in the factory; (2) delivering the framework elements to the job site; (3) placing each framework element into its predetermined position by a crane or the like in accordance with a predetermined sequence; (4) assembling the framework elements into the supporting structure; (5) forming the steps using reinforced concrete material; and (6) finishing the staircase. This structural steel construction of a staircase is more efficient than the reinforced concrete construction method. However, since the accuracy of the reinforced concrete construction of the building is measured by a centimeter while the accuracy of the structural steel construction of the staircase is measured by a millimeter, it is difficult to eliminate dimension inconsistency when both methods are employed respectively together. When a dimension inconsistency occurs, the framework elements may not be set into their predetermined positions. Furthermore, when each framework element is set into the right place, it is difficult to align the framework element with the embedded bolts within the building.

SUMMARY OF THE INVENTION

The present invention provides a prefabricated staircase unit which eliminates the aforesaid drawbacks. It is one object of the present invention to set up a staircase in place before the columns and beams of the building are constructed. It is another object of the present invention to save substantial amounts of time and manpower in the construction of the staircase within a building and, as a result, allow the construction schedule to be easily controlled. It is still another object of the present invention to improve the accuracy and quality of the construction of the staircase.

According to one aspect of the present invention, the prefabricated staircase unit comprises four steel columns disposed vertically to form a rectangular space. Each steel column has attaching mechanisms at both ends for attaching a steel column of a second staircase unit. The invention also includes at least four steel cross bars, each of which is disposed for connecting different steel columns. The invention further includes a staircase disposed within the space defined by the steel columns and the steel cross bars, with the staircase including a base landing and a series of steps.

According to still another aspect of the present invention, a plurality of diagonal steel braces are disposed for connecting different steel columns and for connecting different steel cross bars to reinforce the structure of the staircase unit.

According to still another aspect of the present invention, the staircase further comprises a handrail connected to the staircase.

According to still another aspect of the present invention, the staircase further comprises an intermediate landing.

According to still another aspect of the present invention, each steel column is a pipe-type column.

DETAILED DESCRIPTION OF THE PREFERRED EMBODIMENT

Figure 1:
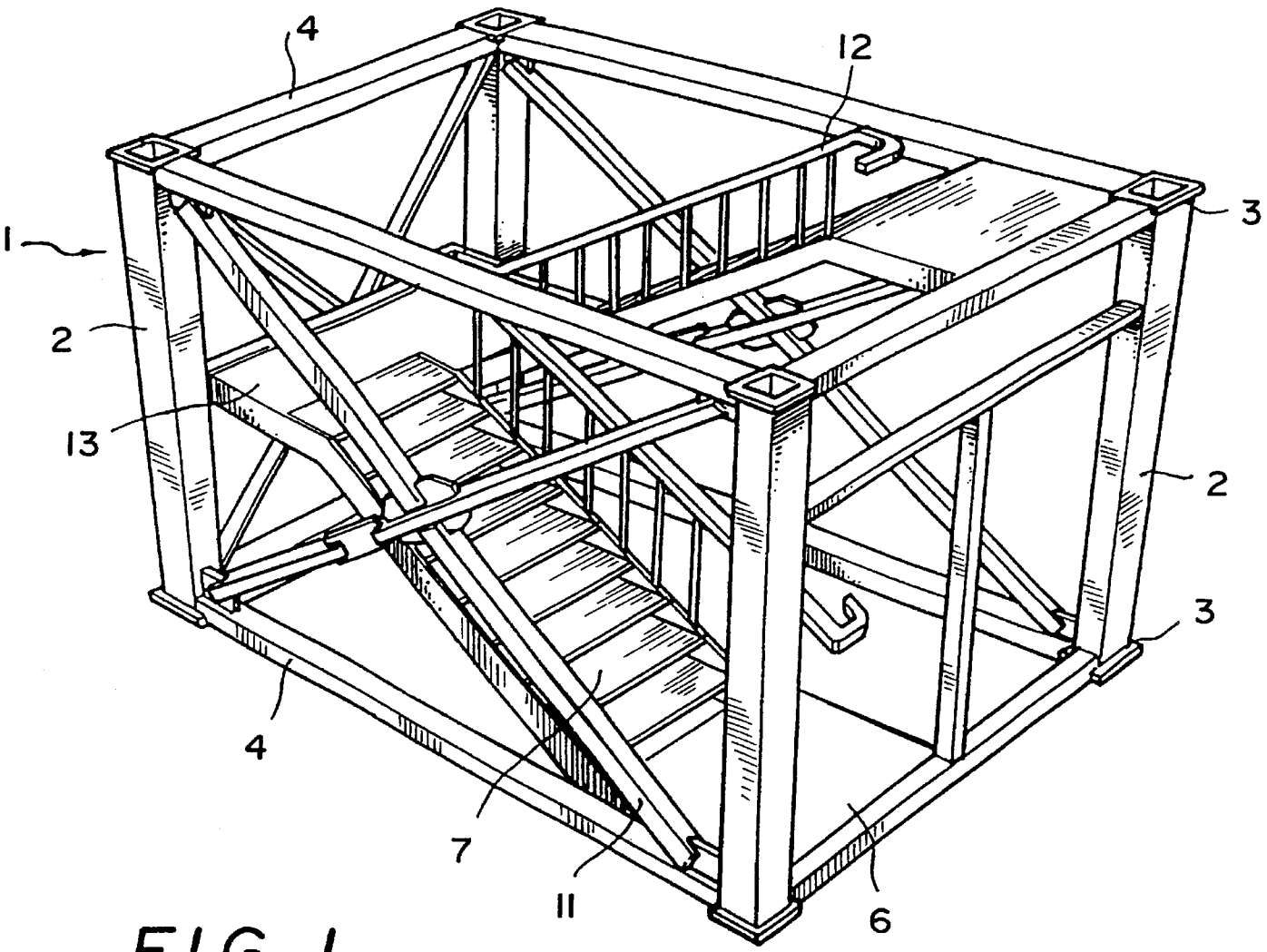
FIG. 1 a perspective view of a precast staircase unit according to the present invention.
Figure 2A:
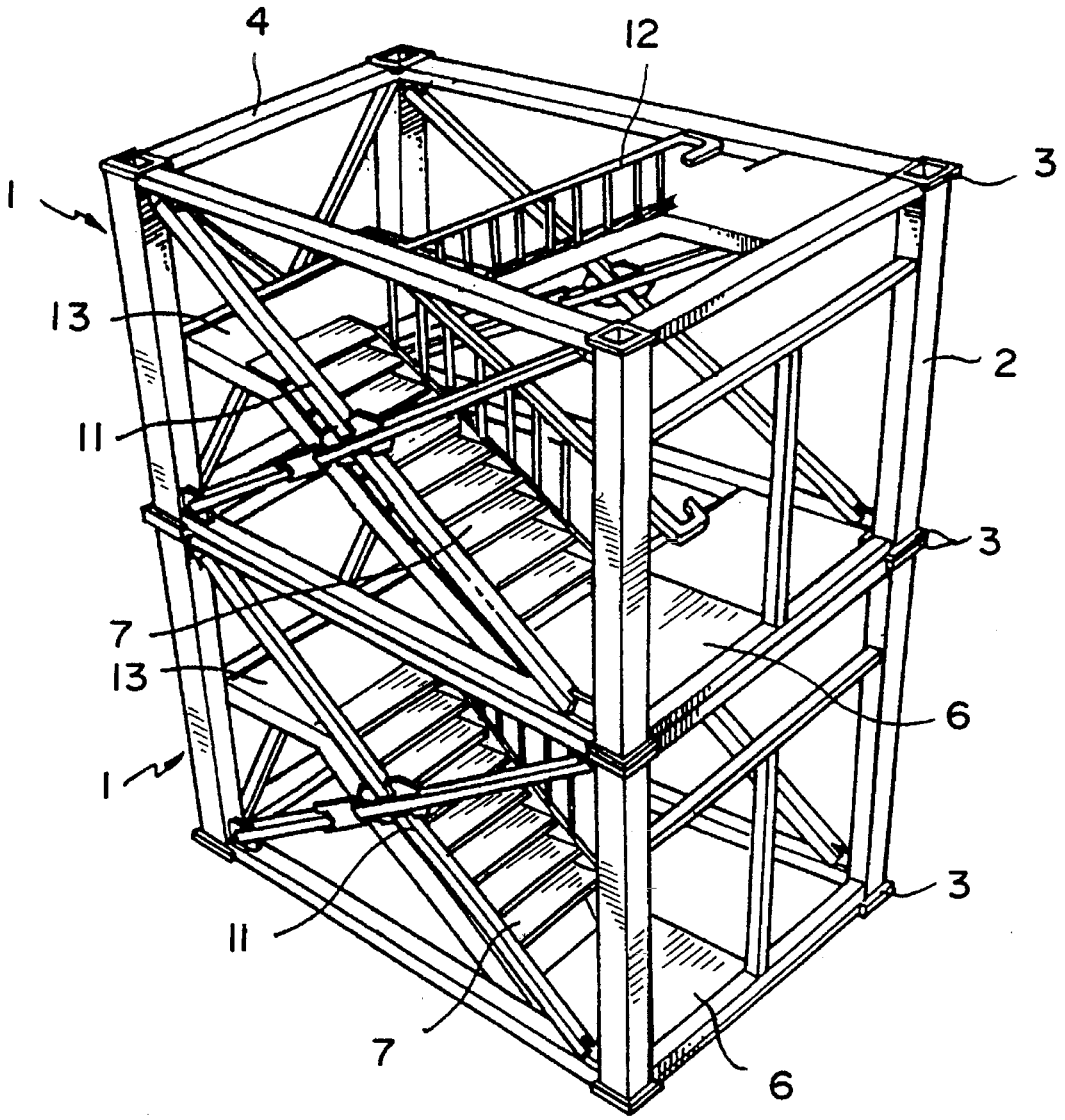
FIG. 2*a* is a perspective view of two precast staircase units of the present invention fastened vertically together.
Figure 2B:
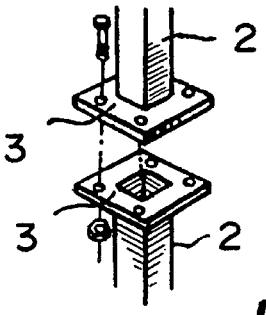
FIG. 2*b* is a partial perspective view of the manner in which two adjacent columns are attached together.

Referring to FIGS. 1 and 2*a*, a precast staircase unit 1 comprises four steel columns 2 disposed vertically to form a rectangular space. An attaching device 3, which may include an apertured flange, is formed on each of two opposite ends of each steel column 2 to attach a steel column of a second precast staircase unit as shown in FIG. 2*b*. Steel cross bars 4 are provided and disposed for connecting different steel columns 2. A staircase is disposed within the space defined by four steel columns 2 and the steel cross bars 4. The staircase consists of a base landing 6, an intermediate landing 13 and a series of steps 7.

By means of the attaching devices 3, the staircase unit 1 can be attached to the floor of the job site. Furthermore, through the attaching devices 3, two staircase units 1 may be vertically assembled together with both assemblies as disclosed in FIG. 2*b*.

Since the present invention is prefabricated in the factory, a plurality of the staircase units 1 can be quickly and accurately assembled on job site before the columns and beams of the building are constructed.

A pipe type column may be selected for the steel column 2 and concrete materials may be filled within the hollow space of the column. Fasteners, such as screws, bolts, nails, or the like can be used to assemble a plurality of the staircase units 1 together or to attach the first staircase unit in the series to the ground of the building.

Diagonal steel braces 11 may be provided to connect different steel columns 2 and to connect different steel cross bars 4 to reinforce the overall structure. A handrail 12 is secured to the steps 7 at one side. A wall board (not shown) may be provided to affix the side surface of the steps 7 at an opposite side.

While one embodiment of the present invention has been shown and described for illustrative purpose, it is to be understood that various modifications and changes could be made without departing from the spirit and scope of the claimed invention.

What is claimed is:

1. A prefabricated staircase unit comprising:

a) four hollow steel columns disposed vertically to form a rectangular space, each steel column having means at both ends thereof for attaching a steel column of another staircase unit;

b) at least four steel cross bars, each steel cross bar being disposed horizontally for connecting different steel columns;

c) a staircase disposed within the space defined by the four steel columns and the steel cross bars, the staircase including a series of steps.

* * * * *